US006993795B2

(12) United States Patent
Prineppi

(10) Patent No.: US 6,993,795 B2
(45) Date of Patent: Feb. 7, 2006

(54) PORTABLE LIQUID DISPENSERS

(75) Inventor: Frank Joseph Prineppi, PMB 341, 1323 SE. 17th St., Fort Lauderdale, FL (US) 33316

(73) Assignee: Frank Joseph Prineppi, Ft. Lauderdale, FL (US)

( * ) Notice: Subject to any disclaimer, the term of this patent is extended or adjusted under 35 U.S.C. 154(b) by 100 days.

(21) Appl. No.: 10/754,122

(22) Filed: Jan. 9, 2004

(65) Prior Publication Data

US 2005/0006403 A1 Jan. 13, 2005

(51) Int. Cl.
*E03D 9/02* (2006.01)

(52) U.S. Cl. ..... 4/227.1; 417/411; 417/477.1

(58) Field of Classification Search ..... 4/222; 417/411, 477.1, 902, 36; 222/64
See application file for complete search history.

(56) References Cited

U.S. PATENT DOCUMENTS 4,365,728 A * 12/1982 Tokorozawa et al. ..... 222/209
4,586,882 A 5/1986 Tseng
4,606,710 A 8/1986 Maguire
4,741,736 A 5/1988 Brown
4,950,136 A 8/1990 Haas
5,395,320 A 3/1995 Padda
5,554,123 A 9/1996 Herskowitz
6,449,779 B1 * 9/2002 Nguyen ..... 4/225.1
6,510,561 B1 * 1/2003 Hammond et al. ..... 4/231

* cited by examiner

*Primary Examiner*—Charles E. Phillips
(74) *Attorney, Agent, or Firm*—Stockwell and Associates

(57) ABSTRACT

A battery operated self-contained submersible liquid dispenser for dispensing discrete quantities of a liquid from a remote liquid reservoir is provided. The dispenser comprises a hermetically sealed walled housing containing a peristaltic pump driven either directly or via a speed reduction gear train by an electric motor in response to motor activation signals received from an electric control circuit within the housing. The pump includes a flexible liquid dispensing tube connected to respective liquid inlet and liquid outlet ports extending through the wall of the housing, a pump actuator for forcing liquid received via the liquid inlet port through the tube to the outlet port, and a sensor on or in the wall of the housing connected to the circuit. The sensor is adapted to sense a changed condition from a required parameter external to the housing, e.g., such as the presence or absence of water, the circuit thereafter activating the motor and hence the pump to dispense a discrete quantity of the liquid

18 Claims, 3 Drawing Sheets

PORTABLE LIQUID DISPENSERS

CROSS-REFERENCE TO RELATED APPLICATION

This application claims the benefit of priority in prior UK Patent Application Serial Number: 0314887.1, filed on Jun. 26, 2003

1. Field of the Invention

This invention relates to portable liquid dispensers of the type including a power source, a pump and a motor for driving the pump, all contained within a single housing and operable to selectively dispense a discrete quantity of a liquid 2. Backgroud of the Invention Portable liquid dispensers are known for dispensing, e.g., medicines, such as insulin, into the body of a recipient, and a system for achieving this is disclosed in U.S. Pat. No. 5,429,602, the disclosure of which is incorporated herein by reference. In that prior art device, a programmable microprocessor is used to perform one or more control functions via the use of a keyboard or similar or automatically via, e.g., a card reader or from an external source via a modem. The present invention is derived from the realisation that such dispenser technology may be adapted to different uses so as to perform tasks that would otherwise be carried out in conventional but substantially different ways.

SUMMARY OF INVENTION

According to a first aspect of the invention there is provided a battery operated self-contained submersible liquid dispenser for selectively dispensing discrete or preselected quantities of a liquid from a remote liquid reservoir. The dispenser comprises a hermetically sealed walled housing containing a peristaltic pump driven either directly or via a speed reduction gear train by an electric motor in response to motor activation signals received from an electric control circuit within the housing. The pump includes a flexible liquid dispensing tube connected to respective liquid inlet and liquid outlet ports extending through the wall of the housing and a pump actuator for forcing liquid received via the liquid inlet port through the tube to the outlet port. A sensor is located on or in the wall of the housing and is connected to the circuit, the sensor being adapted to sense a changed condition from a required parameter external to the housing, e.g., such as the presence or absence of a fluid such as air or water, the circuit thereafter activating the motor and hence the pump to selectively dispense a discrete or preselected quantity of the liquid.

With this arrangement, the liquid dispenser may e.g. be connected via the inlet port to a reservoir of the liquid, e.g., such as a cleaning liquid for cleaning the bowl of a toilet. The housing may ordinarily be submerged near to the top of the toilet cistern such that when a changed condition arises, i.e., the absence of water at the sensor due to the toilet being flushed, a discrete amount of the cleaning liquid may then be discharged into the cistern, either immediately or at some timed interval thereafter, or when the cistern fills up again.

The sensor may conveniently comprise a pair of electrodes, between which a change in electrical resistivity may be sensed as the water is discharged from the cistern when the toilet is flushed.

Conveniently, the microprocessor is programmable by means of external signals, such as through a keyboard mounted on or in the wall of the housing. The microprocessor may also include a timer circuit for activating the motor and hence the pump for a preset duration corresponding to a required rate and hence pre-selected quantity of liquid to be dispensed.

The actuator may conveniently comprise a spoked wheel comprised of a plurality of radially disposed spokes having free ends, the wheel being driven either directly or indirectly via the motor. The free ends of respective adjacent pairs of spokes are adapted to bear directly or indirectly onto the tube at a pre-determined section of the tube to thereby trap therein and between the adjacent spokes a bolus of liquid to be dispensed via the outlet port. As the wheel rotates in response to urging by the motor, the free ends of the spokes push the bolus progressively through the tube and out of the outlet port. In an improvement to this concept, the end of each spoke includes a roller so as to minimize wear and tear on the outside of the tube in this region and to reduce friction, the rollers "pinching" the walls of the tube flat as they roll over the tube.

In a second aspect of the invention, the liquid dispenser is programmed to dispense liquid repeatedly at timed intervals, subject to the condition sensed by the sensor indicating a required parameter, e.g., such as if the housing is submersed in a liquid or not. This embodiment finds particularly advantageous use as a dispenser for dispensing liquid chemicals at regular intervals into, e.g., a swimming pool where, if the sensed condition outside of the housing is dry, no liquid is dispensed, but if the dispenser is submerged, e.g., resting at the bottom of the swimming pool, liquid chemicals such as chlorine, salt, etc. may be dispensed at regular intervals, the sensor or another sensor continually monitoring a required parameter of the swimming pool, such as its pH, salinity, etc.

Other applications for the liquid dispenser of the invention may also be found such as, e.g., an automatic fragrance/deodorizer dispenser, a consumer-programmed automatic plant feeder, and a fish-tan algaecide dispenser in which the user can set up the desired operating interval between delivery and hence make the volume adjustable to thereby deliver a well metered infusion into the fish tank.

In a further refinement, the control circuit may be preprogrammed during manufacture to perform required tasks and the battery may be built into the housing before it is hermetically sealed, thereby making the dispenser relatively cheap to make such that it may simply be a disposable item once the battery has been exhausted.

The invention will now be described, by way of example only, with reference to the accompanying drawings.

DESCRIPTION OF THE PREFERRED EMBODIMENTS

Figure 1:
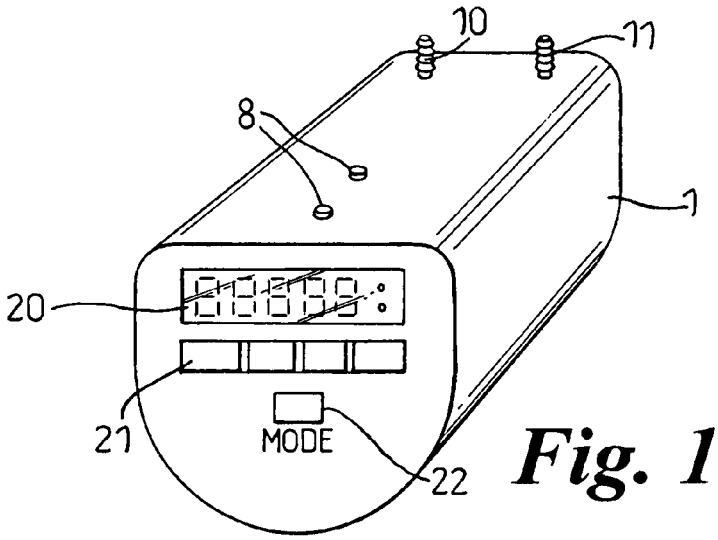
FIG. 1 is a front perspective view of a liquid dispenser in accordance with first and second aspects of the invention.
Figure 2:
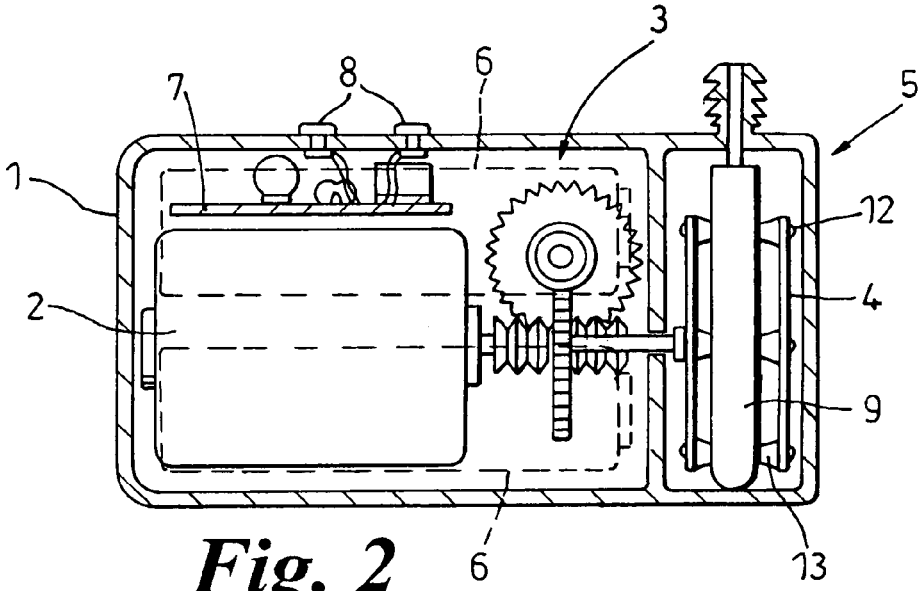
FIG. 2 is a sectional elevation of the liquid dispenser of FIG. 1 showing its internal components.
Figure 3:
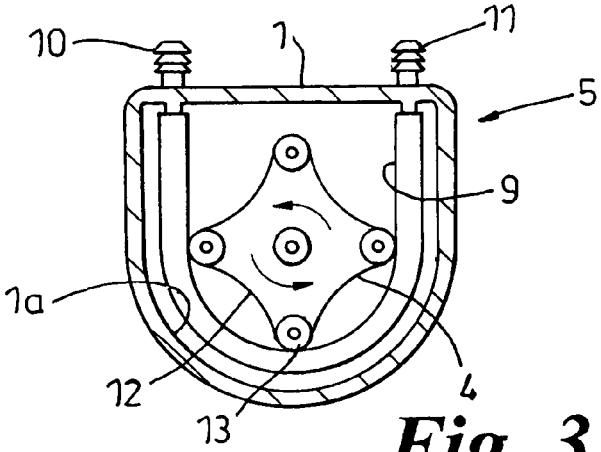
FIG. 3 is a sectional elevation of part of the dispenser of FIG. 1.

Referring firstly to FIGS. 1 to 3, which show the mechanical arrangement of a liquid dispenser, an hermetically sealed walled housing 1 of part-cylindrical shape contains a motor 2, drivingly connected to a double worm wheel and spur gear speed reduction arrangement shown generally at 3 to a rotatable actuator 4 of a peristaltic pump mechanism shown generally at 5. A pair of batteries 6 (shown in outline only in FIG. 2) provide electric power for the motor 2, a printed circuit board 7 connected to it and to a sensor in the form of a pair of electrodes 8 extending through the housing 1.

As can be seen more clearly with reference to FIG. 3, the peristaltic pump mechanism also includes a flexible tube 9, such as of silicone, which bears against the part cylindrical inner wall 1*a* of the housing 1 and each end thereof is connected to respective inlet and outlet ports in the shape of spigots 10, 11 to allow liquid within the tube 9 to be drawn into it via the inlet port 10 and expelled via the outlet port 11.

The pump actuator 4 has four radially disposed spokes or arms 12 carrying respective rollers 13 which bear against the flexible tube 9 such that upon rotation of the actuator in the direction arrowed adjacent pairs of rollers 13 trap therebetween, in use, a bolus of liquid until such is forced out through the outlet port 11 but without such liquid ever entering the hermetically sealed interior of the housing 1 other than to pass through the tube 9.

As will be appreciated, because the actuator 4 is connected to the drive shaft of the motor 2 via the worm and spur gear speed reduction arrangement 3, using a worm gear connected to the drive shaft of the motor to drive a spur gear mounted for rotation with another worm gear in mesh with a second spur gear mounted for rotation with the actuator 4, the combined effect of the gearing means that rotation in the opposite direction of the actuator 4 is effectively impossible so that the combination of gearing and actuator 3 essentially acts as a one way valve mechanism for the tube 9 which, in turn, ensures that liquid pushed out of the tube 9 through the outlet port 11 cannot thereafter return. Also, when the motor 2 stops the actuator 4 effectively locks-up such that, depending upon its rotational position within the housing 1, there are always at least two spokes 12 and respective rollers 13 pressing against the outer wall of the tube 9 to prevent escape or ingress of liquid from or to the reservoir (not shown) to which the inlet port 10 of the dispenser is attached. Such reservoir may conveniently be vented to allow ingress of air and hence escape of liquid when the pump 5 is activated by the motor 2, or the reservoir may be collapsible, the torque generated by the motor 2 and drive train 5 being sufficient to cause the liquid in the reservoir to be sucked out of it until empty.

Figure 4:
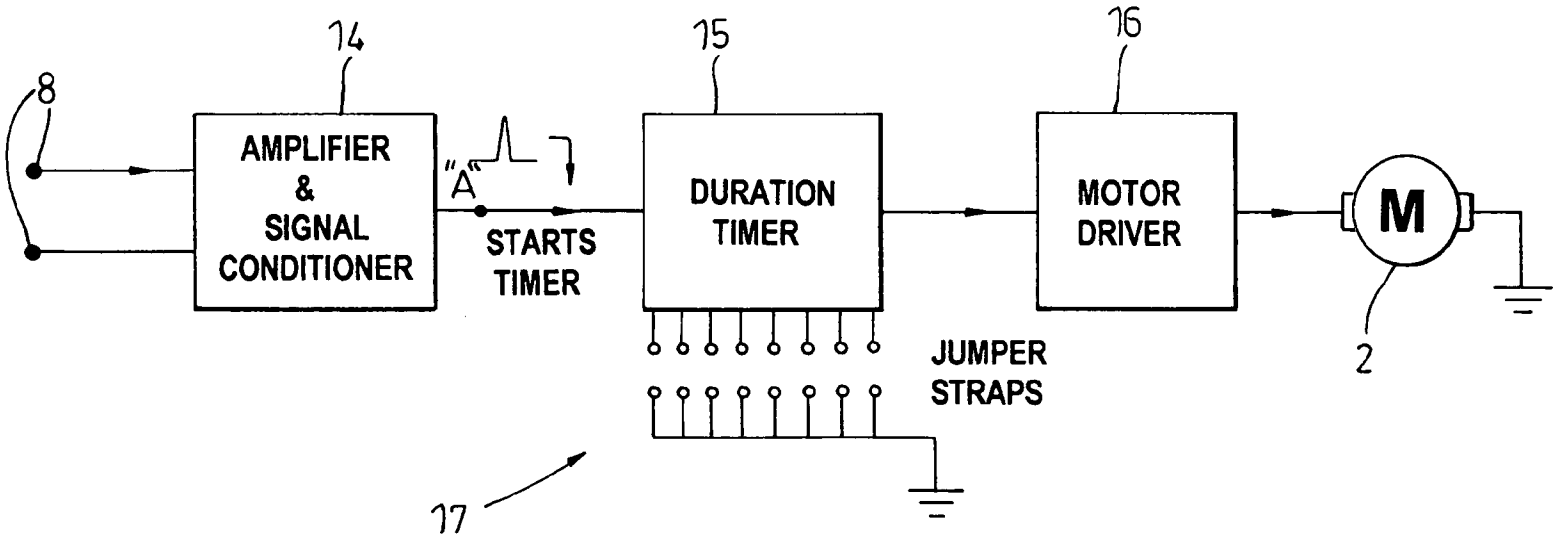
FIG. 4 is a schematic circuit diagram showing how the invention works in accordance with a first embodiment.

Turning now to FIG. 4, there is shown a schematic circuit diagram showing how a first embodiment of the invention operates. In this embodiment the liquid dispenser produces a single pumping cycle per activation when an activation event occurs which is detected by the electrodes 8. This could typically be a change from a wet state corresponding to the electrodes being submerged, such as in a toilet cistern, to a dry state when the cistern has been flushed, at which point a metered infusion of e.g. a disinfectant is then released into the cistern when a change in electrical resistivity is detected between the electrodes 8. This change is detected by the electrodes 8 and the signal is then amplified and processed via an amplifier and signal conditioner circuit 14 which produces a single pulse "A" which activates a duration time circuit 15 for determining how long a motor driver circuit 16 activates the motor 2 and hence the peristaltic pump 5. The duration timer 15 may be factory preset through the use of attendant jumper straps shown generally at 17, although it will be understood that other timing circuits may be used, such as through the use of a decade switchbank or even a simple analogue R-C timing circuit. The embodiment shown in FIG. 4 is, however, particularly simple to adopt and lends itself to mass production and hence relatively inexpensive manufacture aimed especially but not necessarily, at the disposable market.

Figure 5:
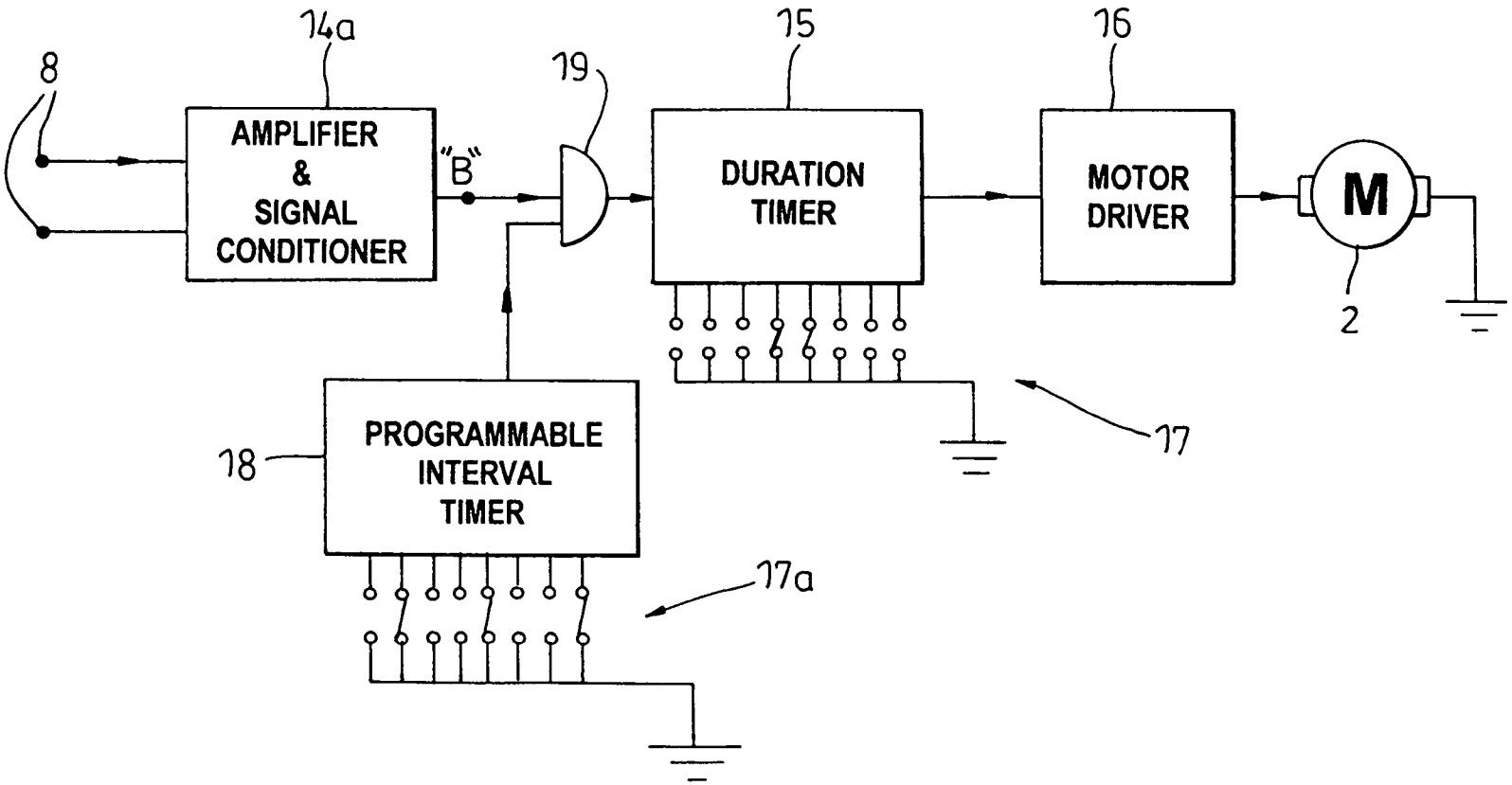
FIG. 5 is a schematic circuit diagram showing how the invention works in accordance with a second embodiment.

Turning now to the more sophisticated circuit shown in FIG. 5, this can be used to provide activation of the motor 2 and hence pump 5 at regular intervals via a separate pre-set interval timer circuit 18 connected via and gate 19. This circuit is designed for use when the electrodes 8 are normally submerged, such as where the liquid dispenser is for dispensing liquid chemicals at regular intervals in e.g. a swimming pool. The amplifier and signal conditioner circuit 14*a* provide a steady state signal "B" to the gate 19 to signal the electrodes 8 are submerged and at regular intervals, pre-set via the jumper straps 17*a*, a "duration elapsed" pulse is then sent to the second input terminal of the gate 19, producing a signal in combination with the steady state signal from the amplifier and signal conditioner 14*a* which triggers the duration timer 15 which, in turn, operates the motor driver circuit 16 and hence motor 2 for the duration specified by the pre-set jumper straps 17. If the electrodes 8 are taken out the water the change of resistivity is sensed by the amplifier and signal conditioner 14*a* which then shuts off the steady state signal until the electrodes 8 are submerged again, effectively switching off the circuit, the programmable interval timer 18 thereafter being unable to send a signal to the duration timer 15 through the gate 19. Again, it will be appreciated that the duration timer 15 and programmable interval timer 18 may use instead of jumper straps 17, 17*a*, e.g., a decade switchbank or a simple analogue R-C timing circuit.

Reverting to FIG. 1, it is envisaged that, depending upon the sophistication of the circuitry and the intended use of the liquid dispenser, digital readout may be provided via a digital display facility 20 using, e.g., an LCD readout, some or all of the circuits may be externally programmable through the use of a keypad 21 and a mode select function 22 may also be used, particularly where, e.g., the liquid dispenser is to be used in variable circumstances, such as in horticulture for, e.g., slow release of fertiliser to suit the particular circumstances in terms of location, type of plant and ambient conditions.

Because the liquid dispenser uses a peristaltic pump it can be manufactured as a hermetically sealed unit which, as aforesaid, lends itself to the mass market and a multitude of uses where accurate liquid metering is required in response to or dependent upon a sensed condition as described above. A further advantage of using a peristaltic pump is that it is able to self-prime and can be used submerged in another liquid whilst at the same time resisting back-flow leakage. Hence, highly concentrated liquids to be dispensed by the device, which would or could cause environmental or other problems to occur in the event of too great a dose being allowed into the environment, can still be safely connected upstream of the pump without the need for separate control valves or taps.

What is claimed is:

1. A battery operated self-contained submersible liquid dispenser for dispensing discrete quantities of a liquid from a remote liquid reservoir, the dispenser comprising a hermetically sealed walled housing containing therein a peristaltic pump driven either directly or via a speed reduction gear train by an electric motor in response to motor activation signals received from an electric control circuit within the housing, the pump including a flexible liquid dispensing tube connected to respective liquid inlet and liquid outlet ports extending through the wall of the housing, a pump actuator for forcing liquid received via the liquid inlet port through the tube to the outlet port, and a sensor on or in the wall of the housing connected to the circuit, the sensor being adapted to sense a changed condition from a required parameter external to the housing, the circuit thereafter activating the motor and hence the pump to dispense a discrete quantity of the liquid.

2. A dispenser according to claim 1, wherein the sensor comprises a pair of electrodes and the changed condition comprises a change in electrical resistivity between the electrodes.

3. A dispenser according to claim 1, wherein the sensor comprises a pair of electrodes and the changed condition comprises detecting the presence or absence of water between the electrodes.

4. A dispenser according to claim 3, wherein the sensor is adapted to detect the presence or absence of water within a toilet cistern such that when the cistern is full, the sensor detects the presence of water within the cistern or when the toilet is flushed the sensor detects the absence of water within the cistern.

5. A dispenser according to claim 1, wherein a microprocessor is contained within said electric control circuit, and is programmable by means of an external signal.

6. A dispenser according to claim 5, wherein the microprocessor is programmed via a keyboard mounted on or in the wall of the housing and connected to the microprocessor.

7. A dispenser according to claim 5, wherein the microprocessor further comprises a timer circuit for activating the motor and hence the pump for a preset duration corresponding to a required rate and hence a pre-selected quantity of the liquid to be dispensed.

8. A dispenser according to claim 1, wherein the actuator comprises a spoked wheel having a plurality of radially disposed spokes each having a free end and driven either directly or indirectly via the motor, the free ends of a respective adjacent pair of spokes being adapted to bear directly or indirectly onto a predetermined section of the tube to thereby trap therebetween a bolus of liquid to be dispensed via the outlet port, the spokes being further adapted to push the bolus progressively through the tube and out of the outlet port as the wheel rotates in response to the urging of the motor.

9. A dispenser according to claim 1, wherein the actuator comprises a spoked wheel having a plurality of radially disposed spokes each having a free and driven either directly or indirectly via the motor, the free ends of a respective adjacent pair of spokes being adapted to bear directly or indirectly onto a pre-determined section of the tube to thereby trap there between a bolus of liquid to be dispensed via the outlet port and the spokes being further adapted to push the bolus progressively through the tube and out of the outlet port as the wheel rotates in response to the urging of the motor, and whereas the end of each spoke further includes a roller so as to minimize wear and tear on the outside of the tube in this region and to reduce friction, the rollers "pinching" the walls of the tube flat as they roll over the tube.

10. A dispenser according to claim 1, programmed to dispense a preselected quantity of the liquid repeatedly at timed intervals, subject to the condition sensed by the sensor indicating a required parameter.

11. A dispenser according to claim 1, wherein the condition sensed by the sensor is the presence or absence of a fluid having a pre-determined characteristic.

12. A dispenser according to claim 11, wherein the fluid is water.

13. A dispenser according to claim 12, wherein the fluid is water and the predetermined characteristic is selected from the group consisting of a desired pH, a desired electrolytic content, and an undesirable pathogen.

14. The dispenser according to claim 12, wherein the fluid is air and the predetermined characteristic is a desired humidity.

15. A dispenser according to claim 1, wherein the control circuit is pre-programmed during manufacture to perform required tasks and the battery is built into the housing before it is hermetically sealed, thereby making the dispenser relatively cheap to make such that it may simply be a disposable item once the battery has been exhausted.

16. A dispenser according to claim 1, further comprising means for preventing backflow of the liquid within the tube such that entry of a fluid at the outlet port is substantially prevented.

17. The dispenser according to claim 16, wherein the means for preventing backflow of the liquid within the tube comprises configuration of the speed reduction gear train the permit rotation of the pump actuator in a single direction.

18. The dispenser according to claim 17, wherein the speed reduction gear train comprises a drive shaft connected to the motor, a first worm gear connected to the drive shaft to drive a first spur gear mounted for rotation with a second worm gear in mesh with a second gear mounted for rotation with the pump actuator, such that rotation of the actuator is effectively permitted to occur in a single direction.

* * * * *